United States Patent [19]

Montgomery

[11] 4,213,534

[45] * Jul. 22, 1980

[54] CHILD-RESISTANT CLOSURE

[75] Inventor: Gary V. Montgomery, Evansville, Ind.

[73] Assignee: Sunbeam Plastics Corporation, Evansville, Ind.

[ * ] Notice: The portion of the term of this patent subsequent to Oct. 30, 1996, has been disclaimed.

[21] Appl. No.: 52,864

[22] Filed: Jun. 28, 1979

Related U.S. Application Data

[63] Continuation-in-part of Ser. No. 966,946, Dec. 6, 1978, Pat. No. 4,172,533.

[51] Int. Cl.[2] ..... B65D 55/02; B65D 85/56; A61J 1/00

[52] U.S. Cl. ..... 215/216

[58] Field of Search ..... 215/216, 217, 218, 219, 215/220, 320

[56] References Cited

U.S. PATENT DOCUMENTS 4,105,132 8/1978 Keeher ..... 215/216

4,117,945 10/1978 Mumford ..... 215/216

4,138,028 2/1979 Price et al. ..... 215/216

*Primary Examiner*—George T. Hall

*Attorney, Agent, or Firm*—Henry K. Leonard

[57] ABSTRACT

A container having a tubular neck and a cup-shaped cap, the container and cap having twist action retaining means such as cooperating threads, in which the container and the cap also have child-resistant locking means. The child-resistant locking means consist of at least one set of co-operating stop and lug, preferably two each. When the cap is turned onto the neck to closed position, that one of the stop or lug on the cap is turned clockwise beyond engagement. The stop has a lug engaging abutment face which is inclined backwardly from its outer edge in a counterclockwise direction. When the cap is turned in retrograde direction toward opening, and the lug engages the abutment face it is urged radially inwardly to more strongly resist unscrewing the cap. The stop and lug are disengageable by radially outwardly deforming the portion of the cap on which one of the stop or lug is formed.

4 Claims, 9 Drawing Figures

CHILD-RESISTANT CLOSURE

This application is a continuation-in-part of my previous application Ser. No. 966,946 filed Dec. 6, 1978 now U.S. Pat. No. 4,172,533.

BACKGROUND OF THE INVENTION

Many child resistant containers for dangerous and potentially harmful materials such as drugs, household chemicals, and the like, have consisted of containers and caps therefor which have cooperating locking means to make them difficult of opening by a child of tender years.

The neck finishes of many of these devices have one or more radially extending abutments or stops on their outer sides, usually adjacent the bases of their necks and the caps usable therewith have depending or inwardly extending lug or lugs which cooperate with the stop or stops after the caps have been screwed onto the containers to closed position to make it difficult for a child to unscrew the caps off of the containers. In these combinations the abutment faces of the stops on the containers lie in radial planes.

A cap for such a combination has a skirt-like portion which is flexible so that it may be squeezed along a diametric line which extends at least generally at right angles to the diametric line of the lug or lugs. This flares the flexible portion outwardly beyond the stop or stops and allowing retrograde rotation of the cap relative to the container.

Child resistant containers and closures therefor are illustrated, for examples, in Gach et al U.S. Pat. No. 3,888,373 and in Mumford U.S. Pat. No. 4,134,513 as well as in many other patents in this art.

Long usage of child resistant combinations such as those being discussed has revealed that frequent opening and closing of the containers, i.e., repeated engagement of the cap lugs with the abutment faces of the container stops, tends to wear away the container stops so that, eventually, mere rotation of the caps in a retrograde direction will cause the cap lugs to be cammed outwardly and thus slid past the container stops rather than being positively engaged therewith to prevent rotation of the caps beyond the child resistant position.

It is, therefore, the principle object of the instant invention to provide container stops which are so designed as to increase the child resistant force upon engagement of the cap lugs with the container stops and to inhibit, if not prevent, the wearing of the container stops in the manner encountered according to the arrangements of the prior art.

In my earlier application Ser. No. 966,946 referred to above now U.S. Pat. No. 4,172,533, I have shown one embodiment of child resistant locking means according to the invention in which the abutment faces of the container stops lie in planes which are parallel to the axis of the neck but not radial and which are inclined backwardly to intersect the exterior of the circular surface of the container at angles of less than 90 degrees to tangents to that surface at the lines of intersection therewith.

The present application discloses the improved stop construction as embodied in other types of cap structures.

DESCRIPTION OF PREFERRED EMBODIMENTS

Figure 1:
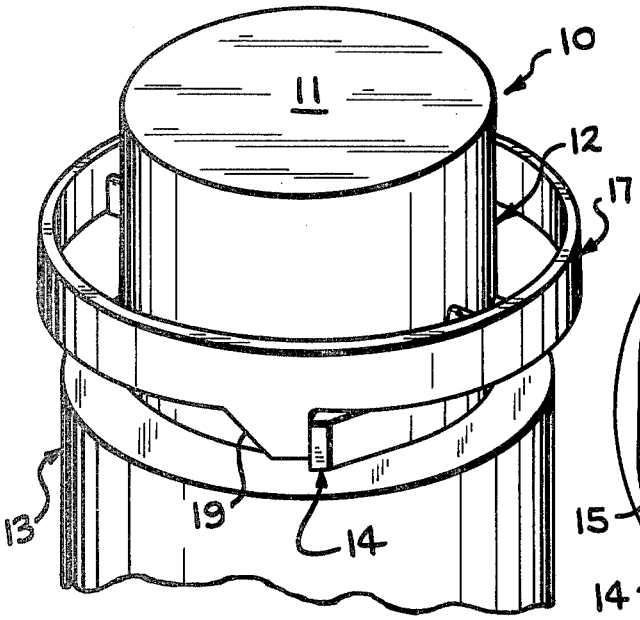
FIG. 1 is a fragmentary view in perspective of that embodiment of the invention which also is disclosed and claimed in my earlier application, Ser. No. 966,946.
Figure 2:
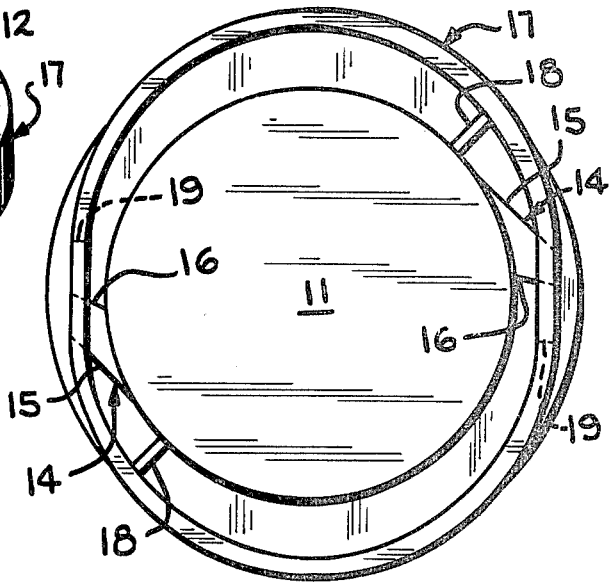
FIG. 2 is a top plan view of the closure illustrated in FIG. 1.

The embodiment of FIGS. 1 and 2 comprises an inverted cup shaped cap 10 which has a disc-like top 11 and an annular skirt 12 depending from the margin of the top 11. The inner surface of the cap 10 conventionally is provided with threads (not shown) which mate with other threads (not shown) on the neck of a container generally indicated by the reference number 13.

The container 13 has two outwardly extending stops which are diametrically opposed to each other in this embodiment. Each of the stops 14 has a generally outwardly extending approach face 15 and an abutment face 16 on the clockwise side of the stop 14. In this embodiment the approach face 14 is illustrated as being tangential to the neck of the container 13, and extending outwardly relative thereto.

The face 16 extends abruptly inwardly from the clockwise end of the stop 14 toward the outer surface of the neck of the container 13, lying in a non-radial plan which is parallel to the axis of the neck of the container 13 but which intersects the outer surface of the neck at an angle less than 90 degrees to a tangent to the neck at the line of the intersection.

The cap 10 also has a second portion, generally indicated by reference No. 17, in this embodiment the second portion being a flexible ring which defines an orbit around the cap skirt 12 and is concentric therewith. The second portion 17 is integrally connected to the outer side of the cap skirt 12 by a pair of struts 18. The second portion 17 also has a pair of depending lugs 19 which normally are circumferentially aligned with the stops 14 so that after the cap 10 has been screwed onto the container 13 to a closed position, the cap 10 cannot be rotated in a retrograde direction to remove it from the container 13 without a manipulation necessary to prevent the engagement of the lugs 19 with the abutment faces 16. Thus a child of tender years is unable to actuate the structure in order to remove the cap 10.

However, when an older child or adult wishes to remove the cap 10, he merely squeezes inwardly against the ring-like second portion 17 along a diameter which is generally perpendicular to the diameter extending between the two lugs 19 and outwardly flares the portions of the ring-like second portion 17 where the lugs 19 are located enabling them to be turned past the stops 14.

It will be particularly noticed that, because of the angular extent of the abutment faces 16, if someone endeavors to turn the cap 10 in a counterclockwise or retrograde direction from the position illustrated in FIGS. 1 and 2, the lugs 19 are cammed even more tightly against the abutment faces 16 of the container stops 14.

Figure 3:
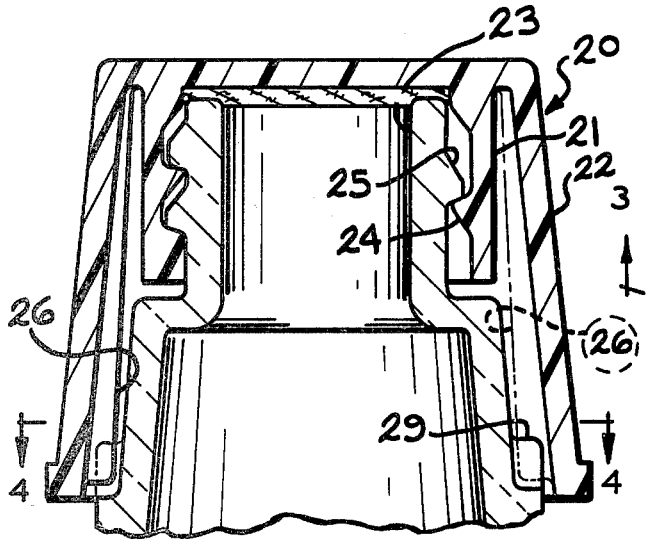
FIG. 3 is a vertical sectional view of a container and closure embodying a second modification of the invention.
Figure 4:
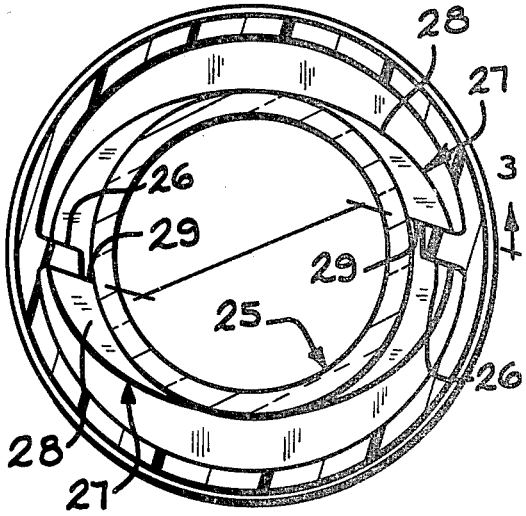
FIG. 4 is a horizontal sectional view taken along the line 4—4 of FIG. 3.

In the second embodiment of the invention illustrated in FIGS. 3 and 4, a cap 20 has two concentric skirts 21 and 22. The cap 20 is shown in position on a container neck 23. Cooperating threads 24 on the inner surface of the inner cap skirt 21 and 25 on the container neck 23 function to retain the cap 20 on the container.

In accordance with the instance invention, a pair of lugs 26 are formed on the inner surface of the outer cap skirt (second portion of the cap) and cooperate with stops 27 on the outer surface of the container 25. Each of the stops 27 has an approach face 28 and an abutment face 29. As in the embodiment of the invention illustrated in FIGS. 1 and 2, the abutment faces 29 lie in planes which are parallel to the axis of the container 25 but such planes are not radial.

In this embodiment of the invention, the second portion of the cap 20 comprising the outer skirt 23 is flexible thereby providing for its being squeezed along a diameter which is at least approximately normal to the diameter extending between the cap lugs 26 in order to flare the flexible skirt portion 23 of the cap 20 outwardly so that the cap lugs 26 will pass the container stops 27 when it desired to unscrew the cap 20.

It will also be noted that in this embodiment of the invention, the cap lugs 26 are located interiorly of the lower margin of the cap skirt 23.

Figure 5:
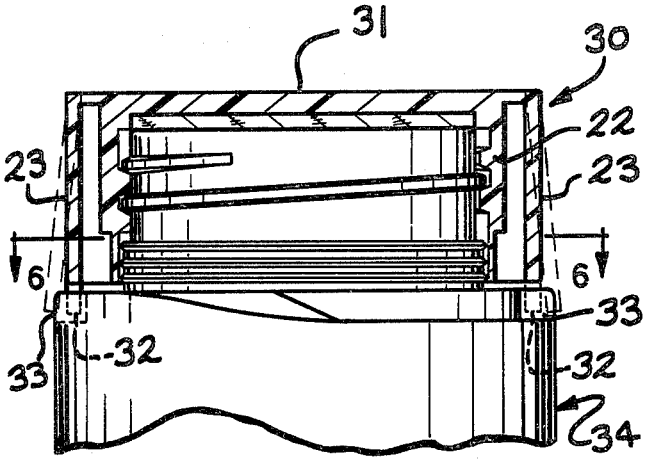
FIG. 5 is a view similar to FIG. 3 but showing a third embodiment of the instant invention.
Figure 6:
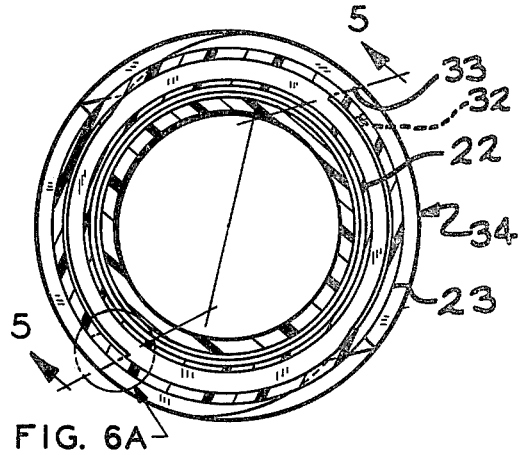
FIG. 6 is a horizontal sectional view taken along the line 6—6 of FIG. 5.
Figure 6A:
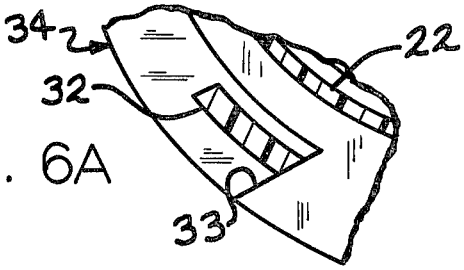
FIG. 6*a* is a further enlarged, detailed, fragmentary, sectional view of that portion of the locking means as indicated by the circle in FIG. 6.

In the embodiment of the invention illustrated in FIGS. 5, 6, and 6*a*, a cap 30 has a disc-like top 31 and two concentric skirts 22 and 23. In general, this embodiment of the invention is similar to the embodiment illustrated in FIGS. 1 and 2 and in FIGS. 3 and 4 in that it also comprises lugs 32 which depend from lower margin of the outer flexible skirt 23. The skirt 23 comprises the second portion of the cap 31 and may be squeezed inwardly along a diameter normal to the diameter extending between the lugs 32 in order to flare the lugs 32 outwardly, as illustrated in broken lines in FIG. 5, so that they will not engage abutment faces 33 molded into the shoulders of a container 34.

In this embodiment of the invention, however, the abutment faces 33 are not portions of protruding stops, as in the case of the embodiments illustrated respectively, in FIGS. 1 and 2 and in FIGS. 3 and 4.

Figure 7:
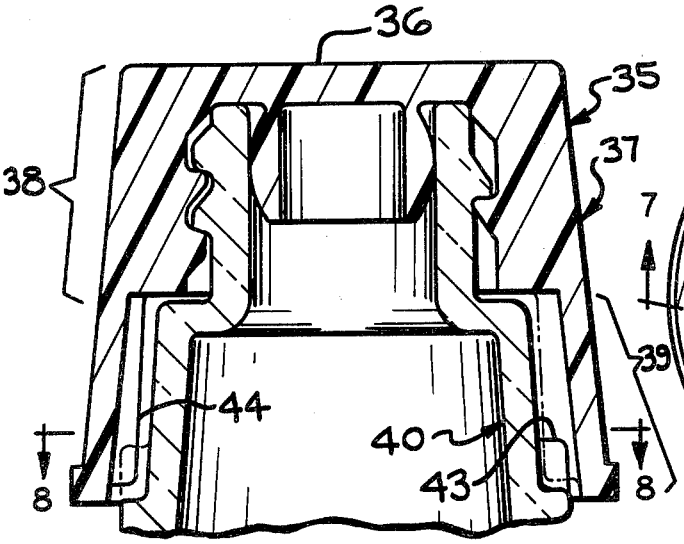
FIG. 7 is a fragmentary, vertical, sectional view of yet another modification of the instant invention and is similar to FIGS. 3 and 5.
Figure 8:
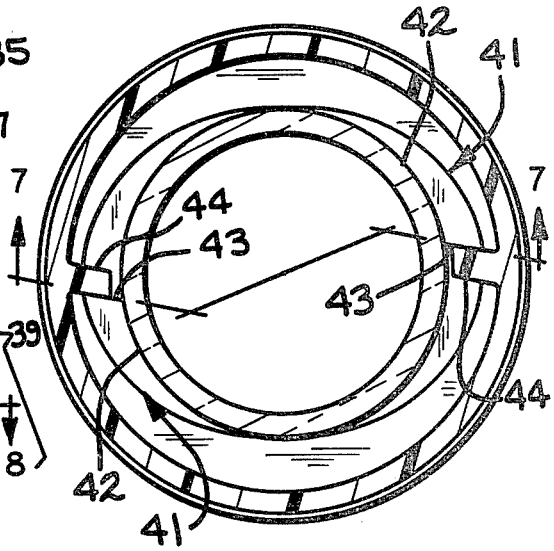
FIG. 8 is a horizontal sectional view taken along the line 8—8 of FIG. 7.

A fourth embodiment of the invention is illustrated in FIGS. 7 and 8. In contrast to the embodiments so far described, a cap 35 which has a disc-like 36 has a single annular skirt 37 which has a stiffer upper portion indicated by the bracket 38 and a more flexible, second, lower portion indicated by the bracket 39.

In common with the earlier described embodiments of the invention, a container 40 has a pair of stops 41 which have outwardly sweeping approach faces 42 and inwardly directed abutment faces 43 at the clockwise ends of the stops 41. Again, the abutment faces 43 lie in vertical, non-radial planes which are parallel to the axis of the container 40 and meet the surface of the container 40 at an angle of less than 90 degrees to a tangent to that surface at the line of intersection.

As in the earlier embodiments the second, flexible portion 39 of the cap 35 has a pair of inwardly directed lugs 44 which engage against the abutment faces 43 when it is attempted to rotate the cap 35 in a retrograde direction in order to remove the cap from the closed position illustrated in the FIGS. 7 and 8. Also as in the case of the earlier embodiments of the invention, it is necessary to squeeze the second flexible portion 39 inwardly along the diameter normal to a diameter extending between the lugs 44 in order to flare the lugs 44 outwardly so that they will not engage against the abutment faces 43 when it is desired to remove the cap 35 from the container 40.

Having described my invention I claim:

1. Child-resistant locking means for a container and a cap therefor in which said container has a body and a tubular neck and said cap is cup-shaped and has a disc-like top and an annular skirt that depends from said top and that is adapted to telescope over said neck, said neck and said cap having cooperating twist action retaining means, said locking means comprising, (a) at least one stop on the outer side of said container, said stop having an approach face and an abutment face on the clockwise side of said stop which extends abruptly inwardly from the clockwise end of said approach face toward the axis of said neck and which lies in a plane which is (1) parallel to the axis of said neck and (2) is inclined backwardly from the end of said approach face and intersects the exterior of said neck at an angle of less than 90° to a tangent to said neck at the line of intersection, (b) a second, resiliently deformable, portion on said cap which is concentric with said annular skirt, and (c) a lug on said second portion that is engageable with said approach face of said stop when said cap approaches closed position on said neck and normally is engageable with said abutment face when said cap is rotated from closed position in a retrograde direction.

2. Child-resistant locking means according to claim 1 in which there are two stops on the container which are positioned diametrically from each other and in which there are two lugs on the second portion of the cap which are similarly positioned.

3. Child-resistant locking means according to claim 1 in which the second, resiliently deformable portion of the cap is a second skirt that depends from the top of said cap and is concentric with the first skirt.

4. Child-resistant locking means according to claim 1 in which the second, resiliently deformable portion of the cap is an annular extension on the cap skirt.

* * * * *